US006052957A

United States Patent [19]

Minnich

[11] Patent Number: 6,052,957

[45] Date of Patent: Apr. 25, 2000

[54] COMPRESSIBLE INSERT

[76] Inventor: Walter W. Minnich, 403 Executive Dr., Marion, Ohio 43302

[21] Appl. No.: 09/117,639

[22] PCT Filed: Feb. 4, 1997

[86] PCT No.: PCT/US97/01621

§ 371 Date: Aug. 3, 1998

§ 102(e) Date: Aug. 3, 1998

[87] PCT Pub. No.: WO97/28343

PCT Pub. Date: Aug. 7, 1997

Related U.S. Application Data

[60] Provisional application No. 60/011,115, Feb. 5, 1996, and provisional application No. 60/025,246, Sep. 16, 1996.

[51] Int. Cl.[7] ..... E06B 3/30

[52] U.S. Cl. ..... 52/202; 52/204.64; 52/204.62; 52/204.69; 52/656.7; 52/656.9; 52/716.8

[58] Field of Search ..... 52/202, 204.591, 52/204.62, 204.64, 204.69, 716.8, 717.05, 656.2, 656.4, 656.7, 656.5, 656.9, 208, 717.01; 49/498.1

[56] References Cited

U.S. PATENT DOCUMENTS

| | | | |
|---|---|---|---|
| 966,627 | 8/1910 | Voltz | 52/204.62 X |
| 2,266,973 | 12/1941 | Horton | 52/204.591 |
| 2,503,862 | 4/1950 | Medford | 49/498.1 X |
| 2,612,972 | 10/1952 | Heimgartner et al. | 52/716.8 X |
| 2,691,193 | 10/1954 | Wissinger . | |
| 2,825,941 | 3/1958 | Lux et al. . | |
| 2,837,782 | 6/1958 | White | 52/716.8 X |
| 3,363,390 | 1/1968 | Crane et al. . | |
| 3,934,385 | 1/1976 | Paulus et al. | 52/716.8 X |
| 4,304,816 | 12/1981 | Bright et al. | 52/716.8 X |
| 4,407,099 | 10/1983 | McLaughlin . | |
| 4,486,990 | 12/1984 | Bauch . | |
| 4,570,406 | 2/1986 | DiFazio | 52/656.7 X |
| 4,668,556 | 5/1987 | Hermann et al. | 52/717.01 X |
| 4,703,598 | 11/1987 | Wilson et al. | 52/204.591 X |
| 5,020,277 | 6/1991 | Hellriegel | 49/498.1 X |
| 5,107,646 | 4/1992 | Tamura | 52/717.01 X |
| 5,338,087 | 8/1994 | Gross et al. | 52/204.591 X |
| 5,809,707 | 9/1998 | Bargados et al. | 52/204.62 |

*Primary Examiner*—Robert Canfield
*Attorney, Agent, or Firm*—Philip J. Pollick

[57] ABSTRACT

Insert (10) is formed from sheet (12) which is slidably held in slit (16) formed in compressible resilient covering (14). Stiffening member (22) is contained in the core of material (14) and has a slit (24) also slidably holding sheet (12). A compressible resilient insert (90) is contained in stiffening member (22). Corner members (26) slidably engage adjacent stiffening member (22) and sheet (12). Insert (90) and covering (14) compressibly hold sheet material (12) in frame (60). Fasteners (30) are used to urge members (22) toward frame (60) thereby further compressing member (14) to close any gaps with frame (60). A quadruple sealing effect is achieved as a result of: 1) the insert (90) between edge (15) and member (22); 2) the clamping action of member (22) on sheet (12); 3) the clamping action of covering (14) on sheet (12); and 4) the compression of covering (14) between frame (60) and member (22).

49 Claims, 6 Drawing Sheets

COMPRESSIBLE INSERT

CROSS REFERENCE TO RELATED APPLICATION

This application claims the benefit of U.S. provisional applications Ser. No. 60/011,115 filed on Feb. 5, 1996 and Ser. No. 60/025,246 filed on Sep. 16, 1996 all of which are incorporated by reference as if completely written herein.

BACKGROUND OF THE INVENTION

1. Field

This invention relates generally to inserts and more particularly to resilient compressible edge inserts for insertion into frames where they are held in place and form a seal with the frames as a result of compression of a compressible, resilient edge material.

2. Background

"Storm windows" have been utilized for years in an effort to reduce drafts and the substantial loss of heat through typical windows. Such storm windows are typically formed from a transparent pane and a framing member which is then inserted into the window frame and held in place with appropriate additional framing and/or fasteners. Such storm windows require considerable labor to construct as a result of the exact measurement and fitting needed to eliminate drafts and form an insulating "dead air space" with the original window and thereby avoid heating and cooling loss in summer and winter climates.

Wissinger (U.S. Pat. No. 2,691,193) provides a resilient but non-compressible sealing strip that engages the edge of a glass panel. A lip portion of the sealing strip curls or curves to engage the window frame. However, the excessive weight of large glass panels tends to cause excessive curl of the bottom member reducing the effectiveness of the seal at the top because no fasteners are used. Further, a flat thin bladed tool must be used to remove the window from the frame with possible resulting damage to the sealing strip. In addition, various molds or extrusion dyes are necessary to provide sealing strips with various sizes of slots to receive various thicknesses of glass.

Lux et al. (U.S. Pat. No. 2,825,941) also uses a sealing strip, but rather than relying on the curl of the outward edge of the sealing strip, uses an inflatable tubular passage with a releasable pressure retaining valve to secure the window in the frame. The use of a pump or other pressurized air supply makes installation cumbersome. Failure to properly seal the connecting valve member to its sealing strip is a source of seal failure and resulting window damage. Loss of air pressure at cold temperatures reduces the seal effectiveness when it is most needed.

Bauch (U.S. Pat. No. 4,486,990) is directed to a window insulation system that uses opaque insulation board. A compressible strip is secured to the insulation board by using an adhesive to bond the strip to the edge of the board or a plastic tape with a pressure sensitive adhesive with release paper that is applied to the side of the insulation panel. In order to preserve the bond between the insulation board and the compressible strip and reduce mechanical stress on the joint, a fabric layer is applied over the joint. Because of the inherent weakness of the edge bonding of the compressible strip to the panel, the invention is limited to lightweight materials such as rigid foamed insulation board. Because the board is opaque, it must be removed daily to afford outdoor activity.

In view of the prior art problems, it is an object of this invention to provide a window insert that eliminates or substantially reduces the need to adhesively join a sealing strip material to a sheet material.

It is a further object of this invention to provide a sealing material that accommodates a wide range of sheet material thicknesses.

It is an object of this invention to provide a stiffening material that supports and strengthens thin and flexible sheet materials.

It is an object of this invention to provide a stiffening material that is light weight and structurally strong.

It is an object of this invention to provide a window insert that is easy to install and remove.

It is an object of this invention to provide a window insert that is free of gaps between the insert and the frame in which it is placed.

It is an object of this invention to provide a window insert that allows for the contraction and expansion of the sheet material.

It is an object of this invention to provide a window insert that is easy to assemble.

It is an object of this invention to eliminate the need for close dimensional tolerances in cutting the materials forming the window inserts.

It is an object of the present invention to reduce the labor costs involves with fabricating window inserts.

It is an object of this invention to provide a window insert with a double air penetration barrier.

It is an object of this invention to provide a window insert that is relatively permanent.

SUMMARY

In an effort to reduce the labor costs as a result of the precise measuring and fitting requirements of previous storm windows and to provide a window or frame insert that is impervious to drafts and leakage, the present invention features a compressible resilient covering with a slit into which the perimeter edge, i.e., the edge of the exterior perimeter, of a sheet material such as glass or Lucite® is received to form a frame insert. The frame insert is held in a window frame by the compression of the compressible, resilient covering. The use of a compressible material with a slit to frame the glass or plastic sheet has the advantage of providing good closure between the edge of the plastic sheet and the receiving frame while at the same time holding the frame insert in the frame. Because of the resiliency of the covering, the sheet material can readily expand and contract within the frame thereby avoiding buckling and warping of the sheet.

For larger applications, a stiffening member is placed within the compressible covering. Although this can be a simple rod or pin structure randomly inserted into the covering, a hollow tubular stiffening member with a longitudinal slit provides additional advantages. By opening the slit slightly to receive the edge of the sheet, a clamping or sealing effect is produced between the sheet and the stiffening member thereby preventing unwanted air leaks around the edge of the sheet when the opening force is released. The use of a tubular (cylindrical) stiffening member gives additional strength as a result of the uniform geometry while the hollow interior significantly reduces its weight. Because the sheet is frictionally slidable in the slit, the stiffening member has the further advantage of not restricting the expansion and contraction of the sheet under varying temperature conditions.

Further advantages are gained by using a hollow tubular (cylindrical) compressible resilient covering with a slit to cover the tubular stiffening member. As with the tubular stiffening member, the slit is opening slightly to receive the sheet edge. On release of the opening force the resilient character of the covering provides a clamping and sealing effect with the sheet. Thus both the stiffening material and the covering material produce clamping and sealing effect with the sheet, in effect, a double seal. Moreover, this double seal is achieved while still allowing the sheet to slidably move into and out of the slit.

Another feature of this invention is the use of fasteners with the insert. Typically the fastener is used with the stiffening material and further compresses the covering material with the frame into which the frame insert is placed thereby improving the sealing effect and eliminating any gaps that may exist between the frame insert and frame. In addition, the fasteners secure the frame insert in place thereby eliminating any safety concerns especially when large pieces of sheet material are used. Also the use of fasteners allows the invention to be used in sheds and similar structures where the insert may be the only glazing that is used or as a hatch to attic and basement crawl spaces.

Another feature of this invention is the use of a slidable stiffening corner. Although it is not necessary to use corner stiffeners, relying instead on the covering for draft control; the use of mitered or butt joints or corner stiffeners substantially reduces corner air leakage. Although the corners can be rigidly joined, a slidable corner has significant advantages in that it allows the stiffer frame to be expanded by the use of fasteners to further reduce any gaps between the frame insert and the frame. The use of a slidable corner maintains the covering compression between the frame insert and the frame afforded through the use of fasteners while providing corner protection thereby avoiding damage to the corners of the sheet material as well as nicking and gouging of the frame during frame insert installation.

Although the stiffening corners may be slidably inserted into the adjacent stiffening members, that is, the corners may have a smaller diameter than the adjacent stiffening members, or the stiffening corners may slidably receive the adjacent stiffening members, that is, the corners have a larger diameter than the adjacent stiffening members; it is desirable that both the adjacent stiffening members and the corners have the same diameter in order to eliminate any gaps with the frame. To this end, this invention features the use of a coupling or splicer that is inserted into both the adjacent stiffening members and the stiffening corner which has the advantage of allowing the use of both corner and edge stiffeners that have the same outside diameter which in turn has the advantage of reducing substantially any gaps between the frame insert and the frame.

Another feature of this invention is the use of a stiffener insert within the hollow core of the stiffening members and stiffening corners. Although this invention contemplates the use of a non-compressible insert which has the advantage of sealing the sheet edge against the stiffener, the feature of a compressible resilient insert has the further advantage of providing an expansive pressure against the stiffener thereby further compressing the compressible covering between the frame insert and frame. A compressible insert also has the advantage of maintaining the slidable movement of the sheet material into and out of the covering and stiffening members.

When all of these features are used in combination, a quadruply sealed frame inset is obtained with the sheet edge sealed with the stiffener by means of the compressible insert, the sheet is doubly sealed with the stiffener and cover as a result of the resilient clamping force of both of these components, and the frame insert is sealed with the frame as a result of the compression of the covering between and frame insert and the frame as a result of the oversized perimeter of the combined sheet and covering with this seal being further enhanced through the use of fasteners that further compress the covering between the frame insert and the frame. Moreover even though the frame insert is quadruply sealed in the frame, all of these combined features still allow the sheet to expand and contract as a result of large temperature changes and thereby avoid the buckling and warping common with plastic sheet materials that are used with more unforgiving framing methods. In addition, the slidable features of this invention allow for wide tolerances in sizing and cutting of the various components of the invention.

As a further feature of this invention an insertion and removal device is provided to easily and effectively insert and remove the frame insert from the frame. Typically this is a handle or knob that is attached either to the sheet or preferably to the stiffening member.

Another feature of this invention is that the various features can be selectively used with one another. Thus the stiffening member and slidable stiffening corners may be used with the stiffening insert and fasteners when draft control is not particularly important. Stiffening members and a compressible resilient covering may be used without stiffening corner members or joints when only a moderate amount of draft control is required. A compressible stiffening member insert and slidable corners along with fasteners are added when quadruply sealed draft control is required.

The foregoing and other features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 2:
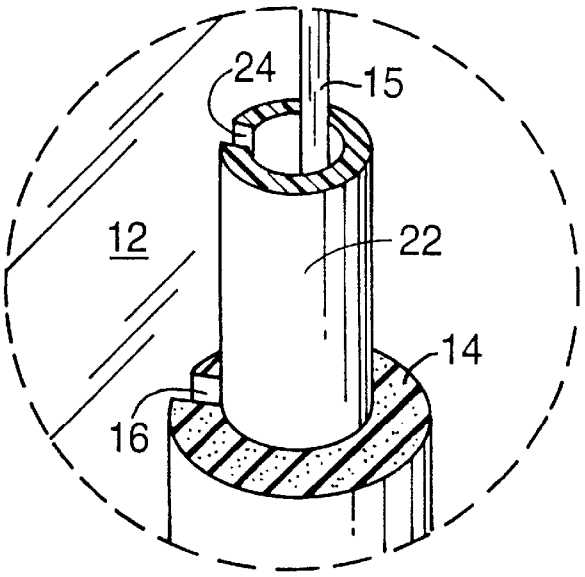
FIG. 2 is an enlargement of portion 2 of FIG. 1 showing in detail the compressible resilient covering with a longitudinal slit for receiving the window sheet material and a stiffening member also formed with a longitudinal slit to receive the sheet material.

In describing the preferred embodiments of the invention which are illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although preferred embodiments of the invention have been herein illustrated, it is understood that various changes and modifications in the illustrated and described structure can be affected without departure from the basic principles that underlie the invention. Changes and modifications of this type are therefore deemed to be circumscribed by the spirit and scope of the invention except as the same may be necessarily modified by the appended claims or reasonable equivalents thereof.

DETAILED DESCRIPTION OF THE INVENTION

Figure 1:
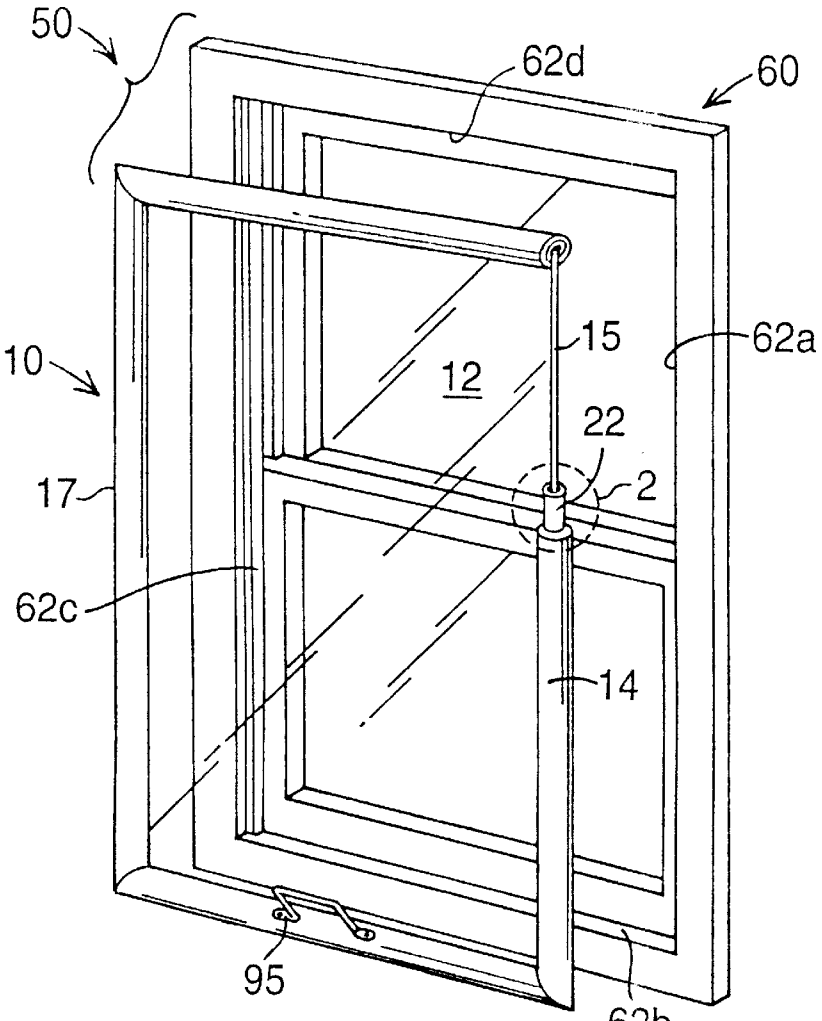
FIG. 1 is a partial cut-away perspective view that illustrates a window frame and window insert assembly. The window insert includes a longitudinally slitted stiffening member and longitudinally slitted compressible resilient outer material.

Referring now in detail to the drawings, numeral 50 refers to a frame and frame insert assembly (FIG. 1). The frame and frame insert assembly 50 includes a frame 60 having an interior frame perimeter 62*a*, 62*b*, 62*c*, and 62*d* and a frame insert 10. The frame insert 10 comprises various selected combinations of sheet 12 (FIGS. 1–16), an outer compressible resilient covering 14 (FIGS. 1-14), stiffening member 22 (FIGS. 1–7 and 11–16), corner stiffening member 26 (FIGS. 14–17), coupling 28 (FIG. 16), insert 90 (FIGS. 6 and 7), fastener 30 (FIG. 3), and insert and removal device 95 (FIG. 1).

Sheet 12 is typically transparent although translucent and even opaque sheet material can be used. Typical transparent sheet material 12 includes, but are not limited to, glass and plastics with plastic sheet materials such as glazing polyacrylics, i.e., Lucite® and Plexiglass®, and polycarbonates preferred in view of their light weight, safety, and low heat loss. Metals and plant-based sheet materials such as wood may also be used but are less preferred because of their typical opacity. Typically a plastic sheet material will range from about 1 to about 10 mm in thickness with thicknesses of 0.093 inches (2.4 mm) and 0.177 inches (4.5 mm) being commonly available. Typically the sheet material 12 is of rectangular shape with a perimeter edge 15 comprising four edge sections and four corners but other shapes including other polygons, circles, ovals, and other combinations of straight and curved edges are contemplated by this invention. Sheet material 12 is formed, typically by cutting, to have an exterior edge 15 that is smaller than the frame perimeter 62*a–d*.

The compressible resilient covering 14 is a rubber, plastic or like material in a flexible, resilient, and compressible sponge-like form. One suitable material for use with this invention is a foamed plastic such as is used to prevent moisture condensation on cold water pipes, e.g., closed-cell polyethylene (PE) pipe covering made by W. J. Dennis and Company (Elgin, Ill.). The compressible resilient covering 14 is used in lengths sufficient to extend around the exterior perimeter edge of the sheet material 12, either in sections or as a single piece. The cross-section of the compressible resilient covering 14 can be of any shape with a circular shape being typical. When the resilient material 14 has a solid (filled) circular cross-section (FIG. 9), the resilient material 14 takes on the shape of a solid cylinder or rod. However often it is desirable to have a hollow opening formed in the interior of the resilient material 14 that extends the length of the material. When this opening or core interior is cylindrical in shape it typically affords a resilient material 14 with an annular cross-section, that is, the compressible resilient covering is in tubular form, i.e., in the shape of an annular cylinder.

Figure 10:
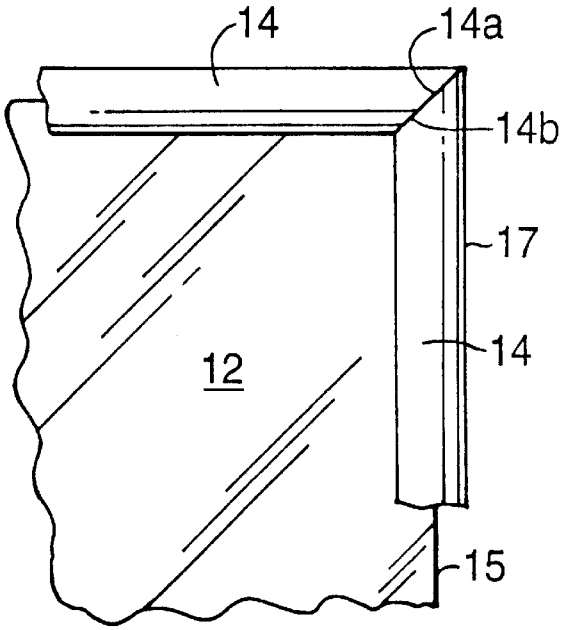
FIG. 10 is a partial plan view of a window insert that illustrates the use of mitered corners for the compressible resilient covering.
Figure 8:
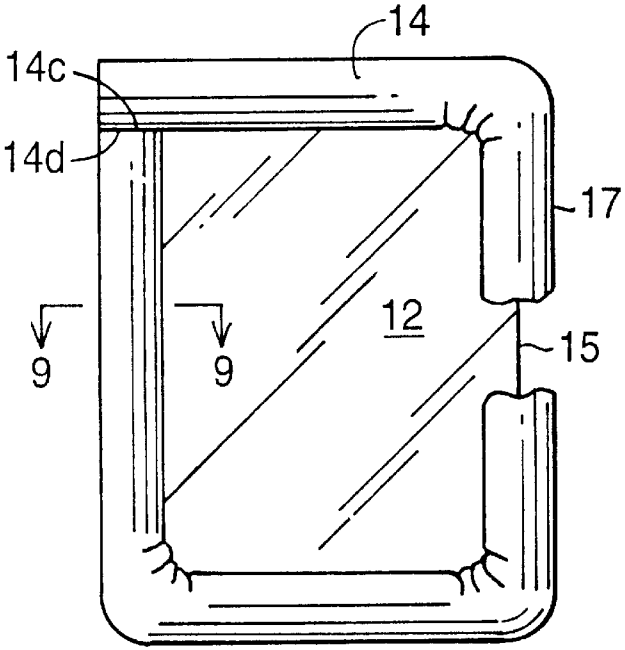
FIG. 8 is a partially cut-away plan view of a window insert in which a resilient compressible material with a longitudinal slit is placed around the edge of the sheet material with a butt-joint at one corner and a wrapping of the resilient compressible material around the other corners.

The compressible resilient covering 14 should have sufficient resiliency and compressibility to return to its original shape after the application of both bending and compression forces. Since the compressible resilient covering 14 has a longitudinal slit 16 that is opened to receive the perimeter edge 15 of sheet material 12, in many instances it is desirable that the compressible resilient covering 14 have sufficient resiliency to close sufficiently to frictionally engage and hold the sheet material 12 so that sheet material 12 is slidably moveable into and out of longitudinal slit 16. Such frictional engagement and slidable movement substantially reduce air seepage at the point of contact between the sheet material 12 and the compressible resilient covering 14 while allowing the sheet material edge 15 to move into and out of slit 16 during normal expansion and contraction of sheet material 12. Such sheet material movement also allows the compressible resilient covering 14 to be compressed against the receiving frame perimeter 62*a–d* to further reduce air seepage between the compressible resilient covering 14 and frame 60. For some applications such as when the resilient material 14 is used with a sheet material 12 of complex perimeter edge 15, especially sheet material geometries with perimeter edge curves, the compressible resilient covering 14 should have sufficient flexibility to conform to the sheet material edge 15. As seen in FIGS. 8 and 10, the compressible resilient covering 14 may be used as a single length in which case it is wrapped around the corners of the sheet material 12 or in sections and the ends 14*a,b* cut to form a miter joint or end edge 14*c* and end 14*d* used to form a butt joint.

Figure 9:
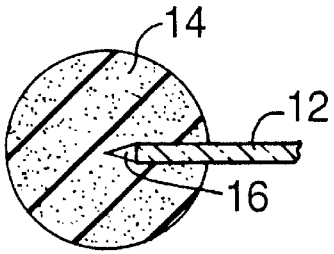
FIG. 9 is a partial cross-sectional view taken along 9—9 of FIG. 8 to show further the compressible resilient covering with the longitudinal slit into which the edge of the sheet material is received.

When a solid compressible resilient covering is used as shown in FIG. 9, a slit 16 extends only partially into the solid compressible resilient covering 14, generally in a direction typically into and toward the center of the compressible resilient covering 14, that is, toward the center line of the material. In the case of a cylinder or rod-shaped material, slit 16 extends toward the longitudinal axis of resilient material 14. Considerable latitude is allowed in the direction of the slit with respect to the center line or axis of the resilient material with the only requirement being that the slit be coextensive, that is, in the same general length-wise direction as the longitudinal or lengthwise center-line of the compressible resilient covering 14. Slit 16 is not required to pass toward or through the centerline or longitudinal axis of the resilient material 14 but may pass to either side of them. Thus for a circular cross section, slit 16 can extend into the cylindrical solid in a radial direction or the slit can extend into the solid in a direction of a chord of the circle. When compressible resilient covering 14 is tubular in shape, i.e., in the shape of an annular cylinder, the longitudinal slit 16 passes completely through the tube or annular cylinder wall, that is, through both the interior and exterior tube surfaces. The slit also passes from one end of the cylinder to the other in a direction coextensive with the longitudinal cylinder axis.

The frame insert 10 comprises the compressible resilient covering 14 and sheet material 12 with perimeter 15 received in slit 16 and has a combined outer perimeter 17 that is larger than the interior perimeter 62*a–d* of frame 60. Inserting frame insert 10 into frame 60 causes compression of compressible resilient covering 14 and holds frame insert 10 in place as a result of the compressed resilient material.

Stiffening members 22 are typically made from rigid plastic pipe such as polyvinyl chloride (PVC) or other plastic pipe such as is used for water service lines into which a slit 24 is cut to receive sheet material 12. Slit 24 is of a width slightly less than the thickness of the sheet material 12 to frictionally engage and hold sheet material 12 so that the edge 15 of sheet material 12 is slidably moveable in and out of longitudinal slit 24. Such frictional engagement and slidable movement substantially reduce air seepage at the point of contact between the sheet material 12 and the stiffening member 22 while allowing the sheet material edge 15 to move into and out of slit 24 during normal expansion and contraction of sheet material 12. Such sheet material movement also allows the stiffening member 22 to be urged against the receiving frame perimeter 62*a–d* by means of a suitable fastener 30 (FIG. 3) thereby compressing the compressible resilient covering 14 between the stiffening member 22 and frame member 62. Although a tubular stiffening member 22 is typically used, that is, a stiffening member 22 in the form of an annular cylinder with a hollow interior, stiffening member 22 can also be of solid construction rather than of tubular material and can be formed in a wide variety of cross-sectional shapes other than the circular shape shown in the figures.

While the stiffening member 22 is typically plastic, it is to be realized that other materials such as metal or wood may also be used. Stiffening member 22 serves to provide rigidity to the sheet material 12, especially when the sheet material is especially thin or when large areas of sheet material 12 are used. The stiffening member 22 typically is inserted or otherwise formed substantially within the compressible material 14, it being realized that the stiffening member 22 may be one or more pins, rods and the like that are inserted into the compressible resilient covering along each edge 15 of the sheet material 12. As used here, the term "a stiffening member 22 substantially contained within the compressible resilient material 14" means that although stiffening member 22 is typically contained within the covering material 14 it can extend beyond the end of covering 14 or into the covering slit 16 as, for example, in FIG. 5. Typically when a hollow tubular compressible resilient cover 14 is used, the stiffening member 22 conforms in size and shape to the hollow core of cover 14.

A hollow plastic tubular material is preferred as the stiffening member 22 for this invention because of its light weight, the strength afforded by a tubular (circular or annular) geometry, and its relatively low heat loss properties. For sheet material 12 with a curved edge 15, it is desirable to use a stiffening member 22 with sufficient flexibility to conform to the sheet material edge curvature. When the sheet material 12 has straight edge sections as is typical with rectangular sheet material configurations, the stiffening member 22 is formed or cut into sections. For a rectangular sheet material, the stiffening member is typically cut into four stiffening section. When a tubular stiffening member 22 is used with a longitudinal slit 24, each of the stiffening member sections receives an edge section of sheet material 12.

Figure 14:
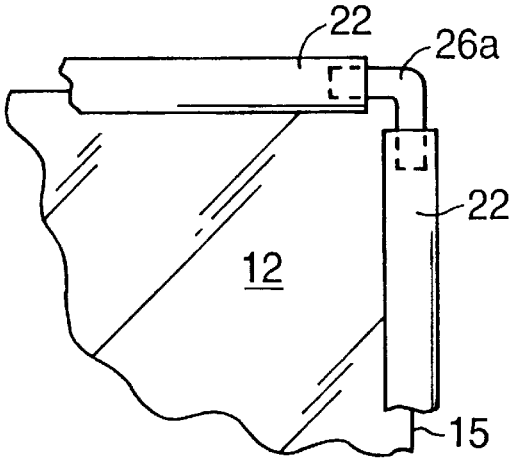
FIG. 14 is a partial plan view of a window insert showing a slitted corner member that receives the corner of the sheet material and whose opposite ends are received into the adjacent stiffening member sections that have been received onto the perimeter edge of the sheet material.
Figure 15:
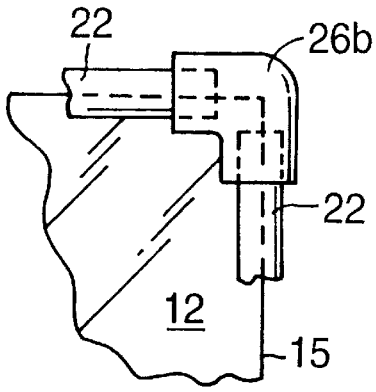
FIG. 15 is a partial plan view of a window insert that illustrates a corner member that receives the ends of the adjacent stiffening member sections that have been received onto the perimeter edge of the sheet material.

Referring to FIGS. 14–17, stiffening corner members 26 are typically formed from right-angled tubular material with an inner radius slit 27 for receiving a corner of sheet material 12. Adjacent stiffening member sections 22 typically slidably engage corner member 26. As shown in FIG. 14, corner member 26 is inserted into and slidably engages the hollow core of stiffening members 22. In FIG. 15, stiffening member sections 22 are inserted into and slidably engage the hollow core of corner member 26. In both cases a size mismatch occurs between the stiffening member section 22 and the stiffening corner member 26. In FIG. 14, the stiffening corner member 26 has a smaller diameter than stiffening member sections 22 while in FIG. 15, the stiffening corner member 26 has a larger diameter than stiffening member section 22. To avoid possible gaps between the frame insert 10 and the frame 60 as a result of the diameter mismatch between the stiffening corner member 26 and the adjacent stiffening member section 22, it is desirable to have the diameters of these two components be substantially equal. To achieve this end, a coupling (splicer) 28 is used that is inserted into the hollow core of the adjacent stiffening member section 22 and the stiffening corner member 28

Figure 16:
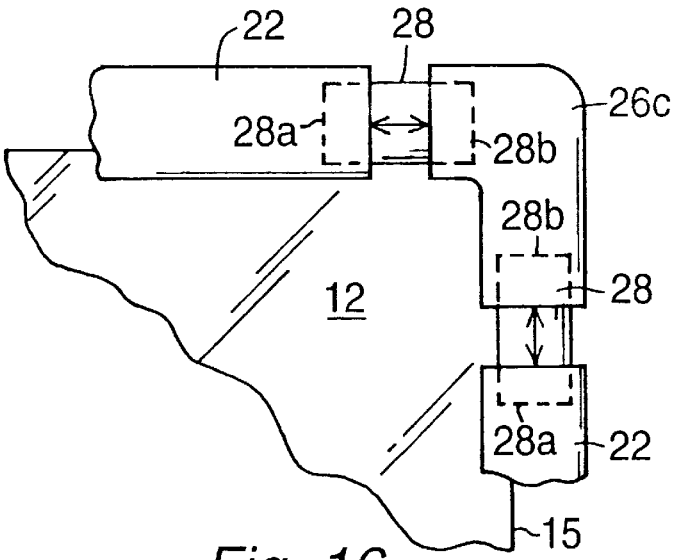
FIG. 16 is a partial plan view of a window insert that shows a slitted corner member that is slidably connected to adjacent stiffening member sections with interior couplings.
Figure 17:
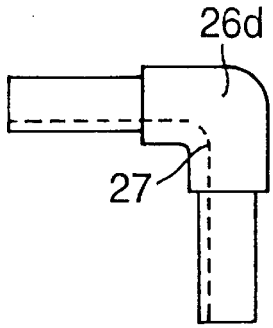
FIG. 17 is a plan view of a slitted corner member and interior coupling formed as an integral unit.

(FIG. 16). Preferably at least one end of the coupling 28, either the first end 28*a* or the second end 28*b* should slidably engage the stiffening corner member 26 or the interior of the adjacent stiffening member section 22, respectively. Typically one of the ends of the coupling is rigidly attached to the adjacent component, either the stiffening corner member 26 or the stiffening member section 22, typically by means of a force fit or with the use of an appropriate adhesive. To eliminate the use of a separate coupling 28 and associated fitting and/or gluing and as shown in FIG. 17, the corner member may be fabricated as a single piece.

Figure 12:
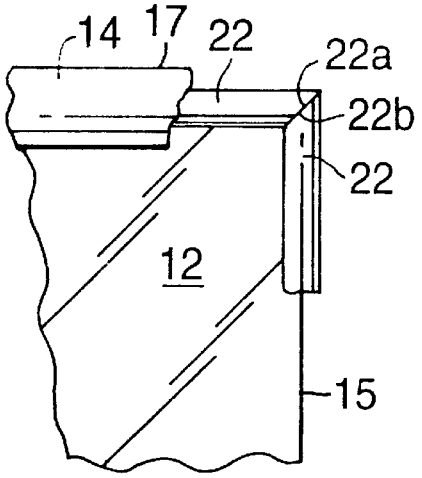
FIG. 12 is a partial plan view of a window insert with the outer resilient compressible material partially removed to show the use of a mitered corner for adjacent stiffening member sections.
Figure 13:
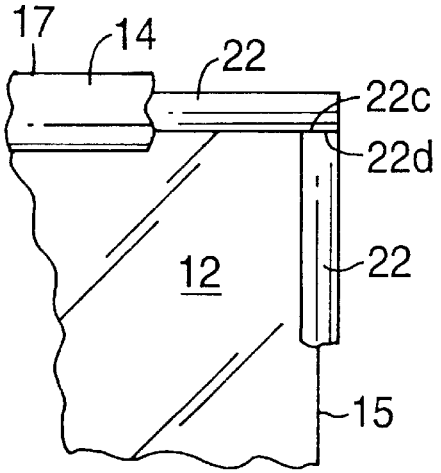
FIG. 13 is a partial plan view of a window insert with the outer resilient compressible material partially removed to illustrates the use of a corner butt-joint for adjacent stiffening member sections.

Although it is not necessary that the stiffening corner member slidably engage the adjacent stiffening member sections 22, such an arrangement is preferable in that it provides a rigid perimeter completely about the perimeter 15 of the sheet material while allowing this rigid frame to expand under the action of a fastener 30 that urges the compressible resilient covering 14 into compression between the window insert 10 and the frame perimeter 62*a–d*. While less preferred, it is to be realized that the corner member 26 and the adjacent member sections 22 may be rigidly joined to each other or alternatively a gap may be left between these two components. Finally it is noted that is not necessary to use stiffening corner member 26. The corners of the sheet material 12 can be left without a stiffening member 22 (FIG. 11) or the stiffening member sections 22 can be cut to form a mitered joint (FIG. 12) or a butt joint (FIG. 13).

Figure 3:
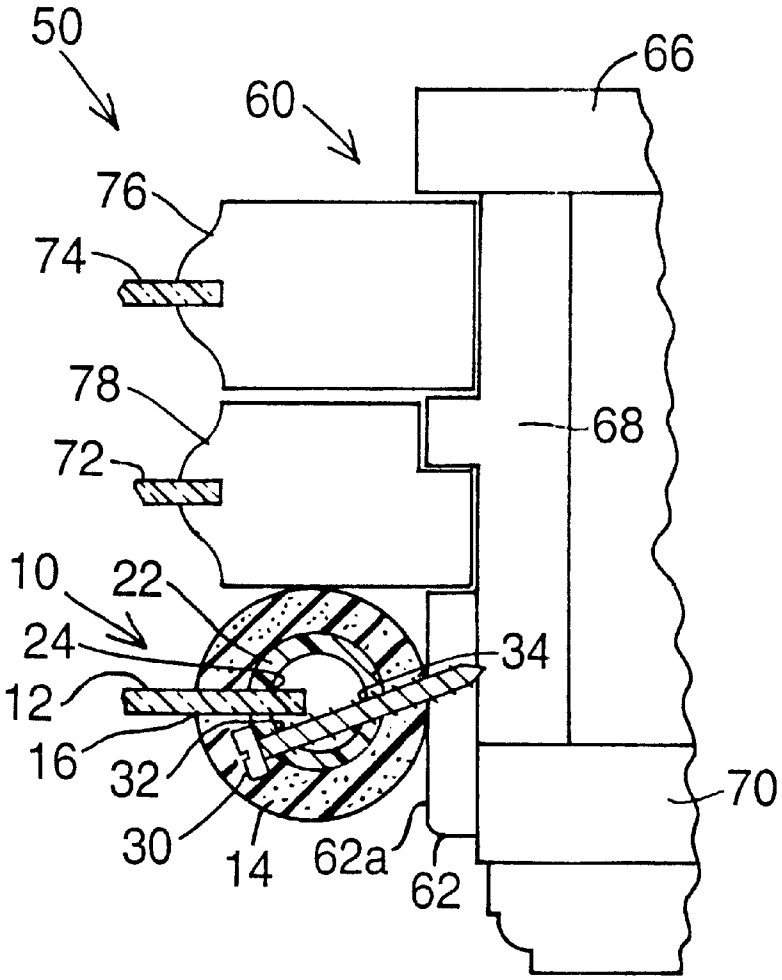
FIG. 3 is a partial cross-sectional view through a window frame and insert assembly that includes a double-hung window as well as the frame insert including a stiffening member, resilient compressible outer material, sheet material and a fastener for further securing the window insert to the frame and further compressing the compressible resilient covering against the frame.

Fasteners such as screw 30 shown in FIG. 3 are used to further secure the frame insert 10 to the frame 60. For small frame inserts 10, the force of the compression of the compressible resilient covering is often sufficient to hold and maintain the frame insert 10 in place within the frame 60. However, with large size windows, it is often desirable to use a fastener 30 to further secure the frame insert 10 within frame 60. When a plastic sheet material is used without a stiffening member 22, an aperture may be drilled through the sheet material and an appropriate fastener 30 used to secure the sheet material to frame 60. Typically when a stiffening member 22 is used, apertures 32 and 34 are drilled in the stiffening member 22 and fastener 30 used to secure the stiffening member 22 to the frame. This arrangement allows for further compression of the compressible resilient covering 14 to insure complete contact with frame 60. Such additional compression is facilitated by the slidable fit of the sheet material 12 in the slit 24 of the stiffening material and the slidable fit of the corner stiffening members 26 with adjacent stiffening members 22. Although screws are the typical fasteners of choice, nails, clips, clamps and like devices that urge the compressible resilient covering into further compression are contemplated by the term fastener.

Insertion and removal devices such as handles 95 (FIG. 1), knobs and the like that assist in inserting and removing the frame insert 10 from the frame can be used. Such devices may be attached to the sheet material 12 directly when a stiffening member 22 is not used. However, typically they are attached to stiffening member 22 using conventional fastening techniques.

Figure 7:
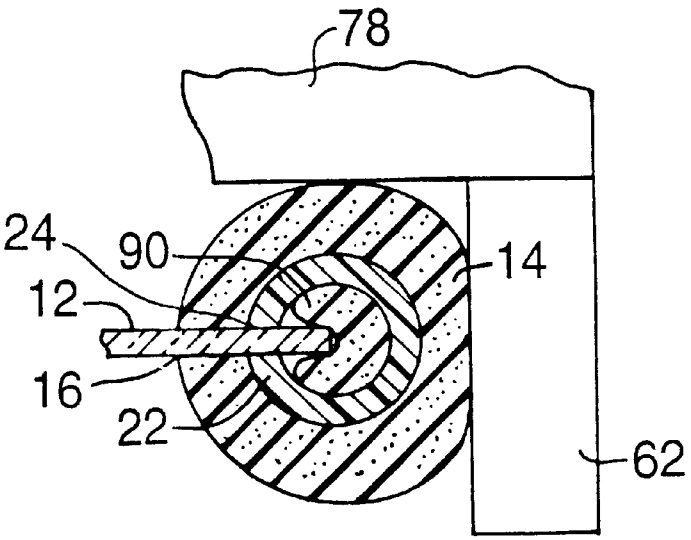
FIG. 7 is a cross-sectional view of a longitudinally slitted outer resilient compressible material and a longitudinally slitted stiffening member with a tubular compressible resilient stiffening member insert contained substantially within the interior core of the stiffening member and showing the sealing effect between the sheet material and the insert and the compression effect exerted on the outer resilient material and the window frame.
Figure 6:
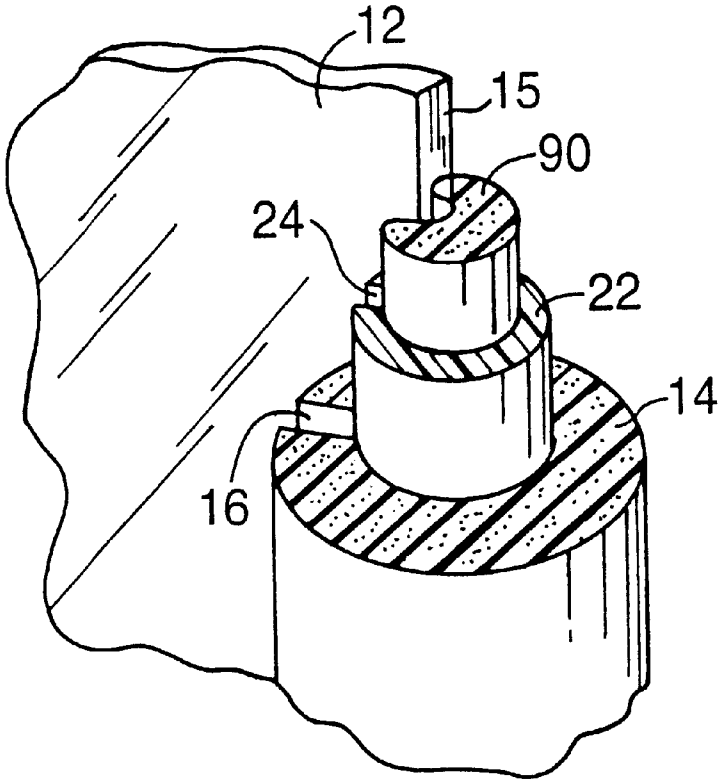
FIG. 6 is a partial cut-away perspective cross-sectional view of a window insert showing the arrangement of sheet material, outer compressible resilient covering, stiffening member, and compressible resilient stiffening member insert.

To further improve the positioning and seal of sheet material 12, an insert 90 is inserted into the interior hollow core stiffening member 22 (FIGS. 6 and 7). The insert 90 is a rubber, plastic or like material typically in a flexible, resilient, and compressible sponge-like form. One suitable material for use with this invention is a foamed plastic in solid cylindrical form such as that which is used in caulking applications, e.g., CaulkSav-R® (W. J. Dennis and Company; Elgin, Ill.). Typically the insert 90 conforms in size and shape to the interior hollow core of stiffening member 22.

As used herein, the phrase that "insert 90 is contained at least substantially within a hollow stiffening member 22" means that it conforms generally to the interior hollow of stiffening member 22 but can also extend beyond the ends of stiffening member section 22 to contact substantially the entire perimeter 15 of sheet material 12. Insert 90 may also extend into the stiffening corner members 26 and coupling 28 when such components are used and can extend into the slit of stiffening member 22. Insert 90 serves to secure and position the transparent sheet material 12 within the framing provided by stiffening member 22 and forms a seal between sheet material 12 and the interior wall of the hollow stiffening member 22. When a resilient material is used as the insert, the resiliency of the insert material 90 tends to push the hollow stiffening member 22 outward tending to compress further the resilient member 14 against the framing members 62 and further improve the seal between the framing members 62 and stiffening member 22.

When a compressible resilient insert 90 is used with a hollow tubular stiffening member 22 with a slit 24 that affords slidable frictional contact of stiffening member 22 with sheet material 12 and a hollow compressible, resilient material 14 with slit 16 that affords slidable frictional contact of compressible resilient covering 14 with sheet material 12, a quadruple sealing effect is achieved. Sheet material 12 is sealed against the interior wall of stiffening member 22 by means of the compressible resilient insert 90; sheet material 12 is sealed against stiffening member 22 as a result of the clamping action exerted by the edges of the stiffening member 22 formed by slit 24 on sheet material 12; sheet material 12 is sealed against stiffening member 22 as a result of the clamping action exerted by the edges of the compressible resilient covering 14 formed by slit 16 on sheet material 12; and the outer surface of stiffening member 22 is sealed against frame 60 as a result of the outward force extended by compressible resilient insert 90 against member 22 that compresses resilient material 14 between stiffening material 22 and frame 60. Moreover, this quadruple sealing effect is maintained while the sheet material 12 slidably moves in and out of the compressible resilient covering 14 and the stiffening member 22 as sheet 12 contracts and expands under changing temperature conditions.

Selected components are assembled for use as frame insert kit with the frame insert kit containing 1) a length of the outer compressible resilient covering 14, with slit 16 formed in it for receiving the edge of sheet 12, 2) a length of the hollow tubular stiffening member 22 with slit 24 formed in it also for receiving the edge of sheet 12; 3) a tubular insert 90, typically of compressible resilient material for insertion into stiffening member 22, and 4) corner stiffening members with each corner stiffening member 26 having a radial slit 27 for receiving a corner of sheet 12. Typically the stiffening member 22 and the corner stiffening member 26 have the same outside diameter and slidably engage each other as discussed above. The frame insert kit can also include insertion or removal devices such as knobs or handles 95.

As a further illustration of the embodiments of this invention, FIG. 1 shows sheet material 12 formed to have an exterior perimeter 15 that is smaller than the interior perimeter 62 a, b, c, d of the frame 60 into which it is inserted. As seen in FIGS. 8 and 9, the compressible resilient covering 14 is placed over the edge 15 of sheet material 12, that is, slit 16 receives the edge 15 of the sheet material. The resulting combined perimeter 17 of the compressible resilient covering 14 with the edge 15 of the sheet material received into slit 16 is greater than the interior perimeter 62 a, b, c, d, of frame 60. As shown more fully in FIG. 3, the window frame 60 consists of framing members 62, 66, 68, and 70 with the member 62 having edge 62*a*. In typical construction well known in the art, the window frame 60 typically has one or more windows 72 and 74 enclosed in suitable framing members 76 and 78. The frame insert 10 with sheet material 12 and compressible resilient covering 14 is placed into the frame by compression of the compressible resilient covering 14 to form a compressed resilient material. The expansion force in the compressed resilient material holds the frame insert 10 in frame 60 to form an insert and frame assembly.

FIG. 8 shows an embodiment of the invention in which the edge 15 of sheet material 12 is inserted into slit 16 of solid compressible resilient covering 14. Three of the corners are formed simply by wrapping cover 14 around the corners. The fourth corner is formed by cutting the ends of covering 14 so that edge 14*c* of one end meet the other end 14*d* to form a butt-joint. As seen in FIG. 10, the compressible resilient covering 14 can be cut into sections with adjacent ends 14*a* and 14*b* of adjacent sections trimmed to afford a mitered corner.

Figure 4:
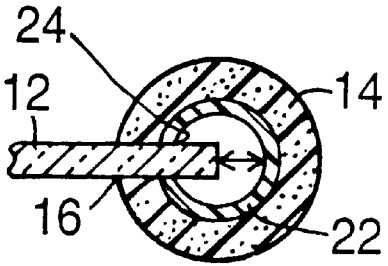
FIG. 4 is a cross-sectional view of the sheet material frictionally held in moveable (slidable) contact with both the outer compressible resilient covering and the stiffening member.
Figure 5:
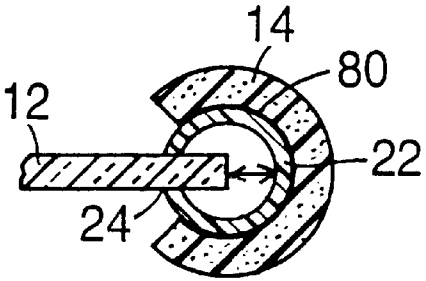
FIG. 5 is a cross-sectional view of the sheet material frictionally held in moveable (slidable) contact with the stiffening member while the compressible resilient covering does not contact the sheet material.

As shown in FIG. 1 and more fully in detail in FIG. 2 and in cross-section in FIGS. 3–5, a stiffening member 22 may be employed with the compressible resilient cover material 14.

The stiffening member 22 has a slit 24 for receiving the edge 15 of sheet material 12 and is enclosed by compressible resilient covering 14 that has a slit 16 for also receiving the edge 15 of sheet 12. When a stiffening member 22 is used, it is not necessary that the resilient material 14 contact the sheet 12 (FIG. 5), although contact is preferred for insulating purposes. In some instances, it may be desirable to attach the resilient covering 14 to the stiffening member with an adhesive. Such attachment can afford easy fabrication when a large number of units are needed and cutting tools for cutting both the compressible resilient covering 14 and the stiffening member 22 simultaneously are available. However such attachment is not preferred since subsequent replacement of the resilient covering 14 becomes more difficult and the use of solvents and adhesives raises environmental and toxicological concerns.

Typically the slit 16 of covering 14 and the slit 24 of stiffening member 22 are spread apart slightly to receive the edge 15 of sheet 12. The resiliency of these two components allows the slit to close and engage the sheet 12 in a slidable frictional contact which allows sheet 12 to move back and forth in slits 16 and 24 as indicated by the arrow in FIG. 4. Although it is not necessary that the covering 14 or stiffening member 22 engage sheet 12, it is preferable that at least one of the two engage sheet 12 and most preferably that both engage sheet 12. The engagement of the stiffening member 22 only is illustrated in FIG. 5 where covering 14 partially covers the stiffening member 22 and does not engage sheet 12. Such stiffening member 22 engagement or covering 14 engagement or both minimizes air leakage about the perimeter 15 of sheet 12. The clamping of sheet 12 allows for the slidable frictional contact and movement of sheet 12 into and out of these components thereby allowing for the thermal contraction and expansion of sheet 12 under varying temperature conditions. Overall such a configuration minimizes drafts, affords a tight seal with the window frame 62, and allows for expansion and contraction of the sheet material 12 within the slits 16 and 24.

Figure 11:
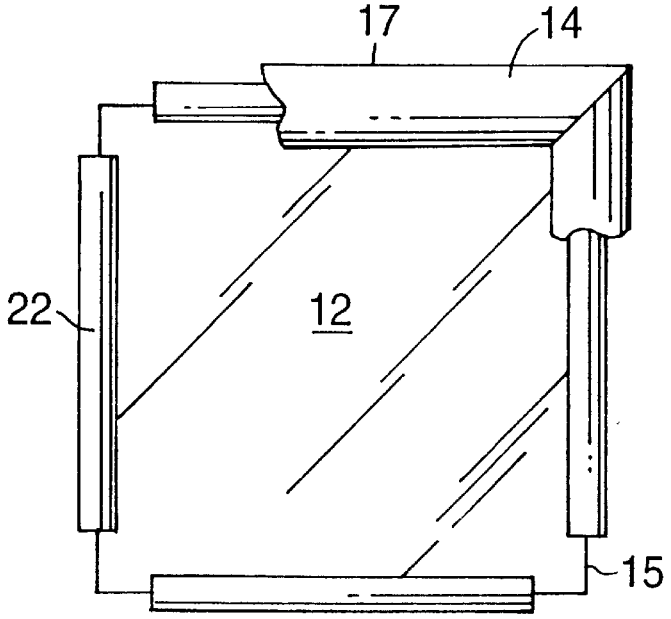
FIG. 11 is a plan view of a window insert with the outer compressible resilient covering partially removed to show stiffening member sections placed over a portion of the edge of each side of a rectangular piece of sheet material and the compressible resilient covering being cut to form a mitered corner.

One of the further advantages of the slidable engagement of the stiffening member 22 and/or compressible resident material 14 with sheet 12 is that it obviates the need for close tolerances when cutting the sheet 12. Because the sheet material slides in slit 16 of the compressible resilient covering 14 and/or in slit 24 of the stiffening members, tolerances of one-half inch (13 mm) or more in the length and width of sheet 12 can be accommodated. In addition, sheets 12 with a large coefficients of thermal expansion may be used since the slidable action of the sheet 12 in slits 16 and/or 24 allows for both contraction and expansion of the sheet 12. FIGS. 11–13 illustrate the use of stiffening members 22 in various configurations. FIG. 11 shows the use of stiffening member sections with each section engaging a separate side of the perimeter 15 of sheet 12. In this configuration each stiffening member section does not extend to the corner of sheet 12. The bare corners are covered with compressible resilient covering 14 using a mitered joint. In FIG. 12, the stiffening member sections fully cover the perimeter edge 15 of each side and adjacent stiffening member sections are cut at their ends to form a mitered joint. Similarly, in FIG. 13 the stiffening member sections also fully cover the perimeter edge of each side of the sheet but adjacent stiffening sections are cut at their ends to form a butt joint in which butt edge 22*c* is adjacent to butt end 22*d*.

FIGS. 14–17 illustrate various embodiments of stiffening corner member 26. Although adjacent sections of stiffening member 22 can be rigidly joined using various types of joints, e.g., FIGS. 12–13, or through the use of a corner piece 26 while still allowing the sheet 12 to expand and contract in slits 16 and 24, it is desirable to provide further flexibility to the frame inset 10 by using a stiffening member design that allows the perimeter of the stiffening member 22 to also expand and contract. This is achieved through the use of a slidable stiffening corner piece 26. In FIG. 14, an inner corner member 26*a* is used that slidably engages the interior of stiffening member 22, that is, corner 26*a* has a sufficiently small diameter so that it can be slidably inserted into the hollow interior of stiffening member 22. In FIG. 15, the opposite is true. Here corner 26*b* has a sufficiently large interior diameter to allow stiffening member 22 to be slidably inserted into its hollow interior. Although both of these embodiments allow the over all perimeter of the stiffening member frame to expand and contract, the mismatch in diameters between the stiffening member 22 and the corner member 26 tends to create a gap at either the corner (FIG. 14) or along the stiffening member 22 (FIG. 15) when the frame insert 10 is placed into frame 60. As seen in FIG. 16, this mismatch can be overcome by using a coupling (splicer) 28 with a corner 26*c* and a stiffening member 22 with substantially the same outside diameter. One end of the splicer 28*a* is inserted into the stiffening member 22 and the other end 28*b* is inserted into corner 26*c*. Although both the stiffening member 22 and corner 26*c* can slidably engage coupling 26*c*, to avoid loss of coupling into the interior of stiffening member 22, the coupling is preferably rigidly attached to either the corner member 26*c* or the stiffening member 22. To further simplify this construction, the coupling 22 and corner 26*c* of FIG. 16 can be formed as a single piece (FIG. 17). Although this invention contemplates the use of sections of stiffening member 22 and corner members 26 to form a frame that can be installed directly into frame 60 and held in place using fasteners 30, it is preferable to use a resilient compressible covering 14 on the exterior of stiffening member 22 and corner 26 in order to fill small gaps that are likely to exist between the stiffening members and the frame.

As shown in FIGS. 6 and 7, the sealing ability of the frame insert can be further improved by the use of insert 90.

Although almost any tubular shaped insert may be used, it is preferable to use a resilient compressible material for the insert. A compressible insert provides a seal for the edge 15 of panel 12 with the stiffening member 22 and corner 26 that allows for the compression and expansion of sheet 12 under varying temperature conditions. In its compressed state, insert 90 exerts an outward force on stiffening member 22 and corner 26 which tends to expand the stiffening member frame and further compress the resilient covering 14 against frame 62.

As shown further in FIG. 3, a fastener 30 such as screw is received in suitable apertures 32 and 34 formed in stiffening member 22. Aperture 32 may be counter sunk to provide a better fit between resilient member 14 and stiffening member 22. The fastener 30 passes through the walls of stiffening member 22 and into frame member 62. The fastener 30 further holds the frame insert in place and further assists in reducing leakage about the frame insert by further compressing the resilient covering 14 against the frame member 62 and window member 78. Fasteners 30 literally expand the stiffening member frame by forcing the stiffening members 22 and associated covering 14 outward as a result of their slidable relation with sheet material 12. Such movement of the compressible resilient covering 14 and the stiffening members 22 allows the compressible resilient covering 14 to be further compressed against the window frame members 62 to afford a tight, draft-free fit.

As seen in FIG. 1, a device 95 for inserting and removing frame inset 10 can be attached with directly to the sheet 12, especially when sheet 12 is a plastic or more preferably to the stiffening member 22. Attachment is accomplished by conventional fastening techniques including the use of adhesives or fasteners such as screws or nuts and bolts.

It will be realized by those skilled in the art that this invention is usable with a wide variety of window frames 60 and that the insert 10 can be used on either the outside or inside of the window as found to be appropriate. Typically, stiffening members 22 and fastening members such as screws 30 are used with larger windows. For curved windows, various combinations of resilient material 14 alone and/or in combination with stiffening members 22 may be used. For example, a window curved at the top would employ resilient material 14 only for the top portion while using stiffening members 22 along the edges and bottom. In some applications such as barns and utility sheds, the insert 10 can serve as the only window especially if held in place with fastener 30. Finally it is to be realized that this improved method of securing and sealing against drafts can be adapted for securing panels of metal, plywood, and the like whenever it is desirable to provide a readily removable closure for a hatch of other opening.

It is possible that changes in configurations to other than those shown could be used but that which is shown if preferred and typical. It is therefore understood that although the present invention has been specifically disclosed with preferred embodiments and examples, modifications to the design concerning sizing, shape, and selection of components will be apparent to those skilled in the art and such modifications and variations are considered to be equivalent to and within the scope of the disclosed invention and the appended claims.

I claim:

1. A frame and frame insert assembly comprising in combination:

a) a frame with an interior perimeter;

b) a frame insert, said frame insert comprising 1) sheet material having an outer edge with an exterior perimeter smaller than said interior perimeter of said frame;

2) a compressible resilient covering having a slit formed therein, said slit receiving said edge of said sheet material;

3) a stiffening member substantially contained within said compressible resilient covering and wherein said stiffening member is an annular cylinder with a hollow interior;

4) a combined perimeter of said compressible resilient covering and said received edge of said sheet material being larger than said interior perimeter of said frame; and 5) said received compressible resilient covering and said sheet material being held in said frame as a result of compression of said compressible resilient covering between said frame and said frame insert.

2. The frame and frame insert assembly according to claim 1 wherein said sheet material is translucent.

3. The frame and frame insert assembly according to claim 1 wherein said sheet material is transparent.

4. The frame and frame insert assembly according to claim 3 wherein said transparent sheet material is glass.

5. The frame and frame insert assembly according to claim 3 wherein said transparent sheet material is plastic.

6. The frame and frame insert assembly according to claim 1 further comprising an insertion and removal device attached to said frame insert for inserting and removing said frame insert from said frame.

7. The frame and frame insert assembly according to claim 1 further comprising at least one fastener to secure said frame insert to said frame.

8. The frame and frame insert assembly according to claim 1 wherein said compressible resilient covering is formed in the shape of a covering cylinder.

9. The frame and frame insert assembly according to claim 8 wherein compressible material extends substantially throughout said covering cylinder.

10. The frame and frame insert assembly according to claim 9 wherein said slit extends partially into said compressible material in a direction coextensive with a longitudinal axis of said covering cylinder.

11. The frame and frame insert assembly according to claim 8 wherein said compressible resilient covering is in the form of an annular covering cylinder with a hollow interior.

12. The frame and frame insert assembly according to claim 1 wherein said slit extends through a wall of said annular covering cylinder in a direction coextensive with a longitudinal axis of said annular covering cylinder.

13. The frame and frame insert assembly according to claim 1 wherein said sheet material is frictionally held in moveable contact with said compressible resilient covering.

14. The frame and frame insert assembly according to claim 1 wherein said sheet material is of rectangular shape with four corners.

15. The frame and frame insert assembly according to claim 14 wherein said compressible resilient covering is wrapped around at least one of said corners.

16. The frame and frame insert assembly according to claim 14 wherein said compressible resilient covering is cut to form a butt joint.

17. The frame and frame insert assembly according to claim 14 wherein said compressible resilient covering is cut to form a mitered joint.

18. The frame and frame insert assembly according to claim 1 further comprising an insertion and removal device attached to said stiffening member for inserting and removing said frame insert from said frame.

19. The frame and frame insert assembly according to claim 1 further comprising at least one fastener to secure said stiffening member to said frame.

20. The frame and frame insert assembly according to claim 1 with said stiffening member having a longitudinal slit formed therein and said stiffening member slit receiving said edge of said sheet material.

21. The frame and frame insert assembly according to claim 20 with said sheet material frictionally held in moveable contact with said stiffening member.

22. The frame and frame insert assembly according to claim 20 wherein said sheet material is of rectangular shape with four edge sections and said stiffening member comprises four stiffening sections with each stiffening section receiving an edge section of said sheet material.

23. The frame and frame insert assembly according to claim 22 wherein adjacent stiffening sections are joined at a corner with a butt joint.

24. The frame and frame insert assembly according to claim 22 wherein adjacent stiffening sections are joined at a corner with a mitered joint.

25. The frame and frame insert assembly according to claim 22 further comprising a hollow corner stiffening member, said corner stiffening member having a slit formed therein for receiving a corner of said sheet material.

26. The frame and frame insert assembly according to claim 25 wherein said hollow corner stiffening member slidably engages adjacent sections of said stiffening member.

27. The frame and frame insert assembly according to claim 26 further comprising a coupling having a first end and a second end with said first end received into an interior of said corner stiffening member and said second end received into an interior of said stiffening member section.

28. The frame and frame insert assembly according to claim 27 wherein said outside diameter of said corner stiffening member and said outside diameter of said stiffening member section are substantially equal.

29. The frame and frame insert assembly according to claim 28 wherein said corner stiffening member and said coupling are formed as a single piece.

30. The frame and frame insert assembly according to claim 1 further comprising an insert substantially contained within said hollow interior of said stiffening member.

31. The frame and frame insert according to claim 30 wherein said insert is a compressible resilient material.

32. A frame insert for use with a frame, said frame insert comprising:

1) sheet material having an edge and an exterior perimeter;
2) a hollow tubular compressible resilient covering having a slit formed therein, said covering slit receiving said edge ot said sheet material;
3) a hollow tubular stiffening member having a slit formed therein, said hollow tubular stiffening member contained at least substantially within said hollow tubular compressible resilient covering and said slit of said hollow tubular stiffening member receiving said edge of said sheet material.

33. The insert according to claim 32 further comprising an insert contained at least substantially within said hollow tubular stiffening member.

34. The insert according to claim 33 wherein said insert is a compressible resilient material.

35. The insert according to claim 32 wherein said sheet material is frictionally held in moveable contact with said hollow tubular compressible resilient covering.

36. The insert according to claim 32 wherein said sheet material is frictionally held in moveable contact with said tubular stiffening member.

37. The insert according to claim 32 wherein said sheet material is frictionally held in moveable contact with both said hollow tubular compressible covering and said tubular stiffening member.

38. The insert according to claim 37 wherein 1) said sheet material is of rectangular shape with four edge sections;
2) said hollow tubular stiffening member comprises four stiffening sections with each stiffening section receiving an edge section of said sheet material; and
3) said hollow tubular compressible resilient covering comprises four hollow tubular compressible resilient covering sections.

39. The insert according to claim 38 wherein said hollow tubular compressible resilient covering sections are joined at corners of said sheet material with mitered joints.

40. The insert according to claim 38 further comprising hollow corner stiffening members, said corner stiffening members having inner radial slits formed therein for receiving corners of said sheet material.

41. The insert according to claim 38 wherein said hollow corner stiffening members slidably engage adjacent sections of said hollow tubular stiffening member sections.

42. The insert assembly according to claim 41 further comprising an insertion and removal device attached to said stiffening member for inserting and removing said frame insert from a frame.

43. A frame insert kit for use with sheet material to form a frame insert, said frame insert kit comprising:

1) a length of hollow tubular compressible resilient covering having a longitudinal slit formed therein, said longitudinal slit for receiving an edge of said sheet material;
2) a length of a hollow tubular stiffening member having a longitudinal slit formed therein, said hollow tubular stiffening member sized to be contained at least substantially within said hollow tubular compressible resilient covering with said longitudinal slit of said hollow tubular stiffening member receiving said edge of said sheet material;
3) a length of insert, said insert sized to be contained at least substantially within said hollow tubular stiffening member; and
4) corner stiffening members, each corner stiffening members having an inner radial slit formed therein for receiving a corner of said sheet material.

44. The frame insert kit according to claim 43 further comprising said sheet material.

45. The frame insert kit according to claim 43 further comprising an insertion and removal device.

46. A frame insert for use with a frame, said frame insert comprising:

1) sheet material having an exterior perimeter;
2) hollow tubular stiffening member sections, each section having a longitudinal slit formed therein, said slit slidably receiving and frictionally holding an edge of said sheet material; and
3) hollow corner stiffening members,
   a) each corner stiffening member having a slit formed therein for slidably receiving and holding a corner ot said sheet material;
   b) each corner stiffening member slidably engaging adjacent hollow tubular stiffening member sections; and 4) one or more fasteners for fastening said stiffening member sections to a frame.

47. The frame insert according to 46 further comprising an insert contained substantially within said stiffening member sections.

48. The frame insert according to 46 further comprising a hollow tubular compressible resilient covering substantially containing said hollow tubular stiffening members and said hollow corner stiffening members.

49. The frame insert according to 49 further comprising an insertion and removal device attached to at least one of said stiffening member sections.

* * * * *

UNITED STATES PATENT AND TRADEMARK OFFICE

CERTIFICATE OF CORRECTION

PATENT NO. : 6,052,957
DATED : April 25, 2000
INVENTOR(S) : Minnich

It is certified that error appears in the above-identified patent and that said Letters Patent is hereby corrected as shown below:

Column 16, claim 38,
Line 8, after the word "claim" delete the numeral "37" and substitute therefor the numeral -- 32 --.

Column 18, claim 49,
Line 3, after the word "to" delete the numeral "49" and substitute therefor the numeral -- 46 --.

Signed and Sealed this

Fifteenth Day of January, 2002

*Attest:*

*Attesting Officer*

JAMES E. ROGAN
*Director of the United States Patent and Trademark Office*